US008756914B2

(12) United States Patent
Nakano et al.

(10) Patent No.: US 8,756,914 B2
(45) Date of Patent: Jun. 24, 2014

(54) EMISSION CONTROL SYSTEM FOR INTERNAL COMBUSTION ENGINE

(71) Applicant: Denso Corporation, Kariya (JP)

(72) Inventors: Kosuke Nakano, Toyota (JP); Shingo Nakata, Kariya (JP); Mikiyasu Matsuoka, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/752,791

(22) Filed: Jan. 29, 2013

(65) Prior Publication Data

US 2013/0192211 A1 Aug. 1, 2013

(30) Foreign Application Priority Data

Feb. 1, 2012 (JP) ..... 2012-20080
Oct. 2, 2012 (JP) ..... 2012-220690

(51) Int. Cl.
*F01N 3/00* (2006.01)

(52) U.S. Cl.
USPC ..... 60/276

(58) Field of Classification Search
USPC ..... 60/276; 73/23.32, 23.33, 114.71, 73/114.72, 114.75; 204/406, 410
See application file for complete search history.

(56) References Cited

U.S. PATENT DOCUMENTS 4,741,817 A 5/1988 Croset et al.
6,055,972 A * 5/2000 Fujimoto et al. ..... 123/688
2008/0060939 A1* 3/2008 Inoue et al. ..... 204/401
2008/0185289 A1* 8/2008 Matsuoka et al. ..... 204/425
2011/0271665 A1* 11/2011 Iwazaki et al. ..... 60/301
2012/0022772 A1* 1/2012 Miyamoto et al. ..... 701/104
2012/0043205 A1 2/2012 Matsuoka et al.
2013/0192210 A1 8/2013 Nakano et al.

FOREIGN PATENT DOCUMENTS

JP 2000-054826 2/2000

OTHER PUBLICATIONS

Nakano, et al., U.S. Appl. No. 13/752,728, filed Jan. 29, 2013.

* cited by examiner

*Primary Examiner* — Thomas Denion
*Assistant Examiner* — Jason Shanske
(74) *Attorney, Agent, or Firm* — Nixon & Vanderhye PC

(57) ABSTRACT

An emission control system for an engine includes a catalyst and an exhaust-gas sensor provided downstream of the catalyst in a flow direction of exhaust gas. The exhaust-gas sensor includes a sensor element that includes a pair of electrodes and a solid electrolyte body located between the electrodes. The emission control system further includes a constant current supply portion that changes an output characteristic of the exhaust-gas sensor by applying a constant current between the electrodes, a catalytic-state determination portion which determines a rich/lean state of the catalyst, a rich direction control portion which performs and terminates a rich direction control depending on the rich/lean state of the catalyst, a lean direction control portion which performs a lean direction control after the rich direction control, and a characteristic control portion which performs a lean responsiveness control at least during the lean direction control.

5 Claims, 9 Drawing Sheets

EMISSION CONTROL SYSTEM FOR INTERNAL COMBUSTION ENGINE

CROSS REFERENCE TO RELATED APPLICATION

This application is based on and incorporates herein by reference Japanese Patent Applications No. 2012-020080 filed on Feb. 1, 2012, and No. 2012-220690 filed on Oct. 2, 2012.

TECHNICAL FIELD

The present disclosure relates to an emission control system for an internal combustion engine, which includes a catalyst used for purification of exhaust gas and an exhaust-gas sensor arranged downstream of the catalyst in a flow direction of the exhaust gas.

BACKGROUND

Conventionally, for purpose of improvement of catalytic conversion efficiency of a catalyst used for purification of exhaust gas, an emission control system for an internal combustion engine includes exhaust-gas sensors (e.g., an air/fuel sensor and an oxygen sensor) that are respectively disposed upstream and downstream of the catalyst in a flow direction of the exhaust gas. The exhaust-gas sensors detect an air-fuel ratio of the exhaust gas or detect whether the exhaust gas is rich or lean.

When the air-fuel ratio of the exhaust gas changes from rich to lean or from lean to rich, an output change of the exhaust-gas sensor (e.g., an oxygen sensor) may lag behind a change of an actual air-fuel ratio of the exhaust gas. Thus, the exhaust-gas sensor may have a room for improvement in detection responsiveness.

For example, as described in Patent Document 1 (JP 8-20414 corresponding to U.S. Pat. No. 4,741,817), at least one of an auxiliary electrochemical cell is incorporated to an inside of a gas sensor such as an oxygen sensor for increase in detection responsiveness.

As described in Patent Document 2 (JP 2000-054826 A), a catalyst such as a three-way catalyst used for purification of exhaust gas may become in a lean state, in which an oxygen amount stored in the catalyst (i.e., an oxygen amount adsorbed in the catalyst) is relatively large, after termination of a fuelling-stop control in which fuel injection of an internal combustion engine is stopped, i.e., after resumption of the fuel injection. A rich direction control is performed after the fuelling-stop control in an emission control device in Patent Document 2, in which an air-fuel ratio of exhaust gas is controlled to be richer. By performing the rich direction control, it can be limited that the catalyst becomes in the lean state, in other words, the oxygen amount stored in the catalyst can be reduced.

In Patent Document 1, the auxiliary electrochemical cell is necessarily incorporated to the inside of the gas sensor. Thus, when the auxiliary electrochemical cell is incorporated to a general gas sensor that does not have an auxiliary electrochemical cell, the general gas sensor may need to be changed greatly in structure. For practical use, the gas sensor may be required to be changed in design, and a manufacturing cost of the gas sensor may be increased.

In the emission control device described in Patent Document 2, the rich direction control is performed after the termination of the fuelling-stop control, so that it is limited that the catalyst becomes in the lean state. The rich direction control may be terminated when the limitation of the lean state of the catalyst is determined to be finished (i.e., the catalyst is determined to be in a rich state) after the start of the rich direction control based on an output of an exhaust-gas sensor located downstream of the catalyst in a flow direction of the exhaust gas. In this case, an almost entire region of the catalyst may become in the rich state, and catalytic conversion efficiency with respect to CO or HC (rich component) may decrease.

Thus, after the termination of the rich direction control, a lean direction control may be performed to limit that the catalyst becomes in the rich state in which an air-fuel ratio of exhaust gas flowing into the catalyst is controlled to be leaner than a normal target air-fuel ratio. The lean direction control may be terminated when the limitation of the rich state of the catalyst is determined to be finished (i.e., the catalyst is determined to be in the lean state) after the start of the lean direction control based on the output of the exhaust-gas sensor. In this case, an almost entire region of the catalyst may become in the lean state, and catalytic conversion efficiency with respect to NOx (lean component) may decrease.

It is an objective of the present disclosure to provide an emission control system for an internal combustion engine, which is capable of changing an output characteristic of an exhaust-gas sensor without great change in design and cost increase, and capable of limiting deterioration of emission gas due to a rich direction control or a lean direction control.

SUMMARY

According to an aspect of the present disclosure, an emission control system for an internal combustion engine includes a catalyst, an exhaust-gas sensor, a constant current supply portion, a catalytic-state determination portion, a rich direction control portion, a lean direction control portion and a characteristic control portion. The catalyst is used for purification of exhaust gas discharged from the engine. The exhaust-gas sensor is provided downstream of the catalyst in a flow direction of the exhaust gas to detect an air-fuel ratio of the exhaust gas or detect whether the exhaust gas is rich or lean. The exhaust-gas sensor includes a sensor element that includes a pair of electrodes and a solid electrolyte body located between the pair of electrodes. The constant current supply portion is configured to change an output characteristic of the exhaust-gas sensor by applying a constant current between the pair of electrodes. The catalytic-state determination portion is configured to determine whether the catalyst is in a rich state or in a lean state. The rich direction control portion is configured to perform a rich direction control, in which an air-fuel ratio of the exhaust gas flowing into the catalyst is made to be richer than a normal target air-fuel ratio set based on a normal operation condition, when the catalytic-state determination portion determines that the catalyst is in the lean state. The rich direction control portion is configured to terminate the rich direction control when the catalytic-state determination portion determines that the catalyst is in the rich state after a start of the rich direction control. The lean direction control portion is configured to perform a lean direction control, in which the air-fuel ratio of the exhaust gas flowing into the catalyst is made to be leaner than the normal target air-fuel ratio set based on the normal operation condition, after the rich direction control portion terminates the rich direction control. The characteristic control portion is configured to perform a lean responsiveness control, in which the constant current supply portion is controlled to set a flow direction of the constant current so as to increase a detection responsiveness of the exhaust-gas sensor with respect to lean gas, at least during the lean direction control.

Accordingly, the output characteristic of the exhaust-gas sensor can be changed by applying the constant current between the pair of electrodes. In this case, there is no need to incorporate an auxiliary electrochemical cell or the like to an inside of the exhaust-gas sensor. Therefore, the output characteristic of the exhaust-gas sensor can be changed without great design changes and cost increase. Moreover, by performing the lean direction control after the termination of the rich direction control, it can be limited that the catalyst becomes in the rich state, and catalytic conversion efficiency of the catalyst with respect to CO or HC (rich component) generated in the rich direction control can be prevented from decreasing. Furthermore, by performing the lean responsiveness control, the lean direction control can be terminated before an almost entire region of the catalyst becomes in the lean state, and catalytic conversion efficiency of the catalyst with respect to NOx (lean component) can be prevented from decreasing.

The characteristic control portion may set the constant current in the lean responsiveness control at a value higher than a value of the constant current for a normal operation. The characteristic control portion may set the constant current at a value for the normal operation when the catalytic-state determination portion determines that the catalyst is in the lean state after a start of the lean direction control. The characteristic control portion may set a value of the constant current based on an operational state of the engine in the lean responsiveness control. The characteristic control portion may perform a rich responsiveness control, in which the constant current supply portion is controlled to increase a detection responsiveness of the exhaust-gas sensor with respect to rich gas, during the rich direction control.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
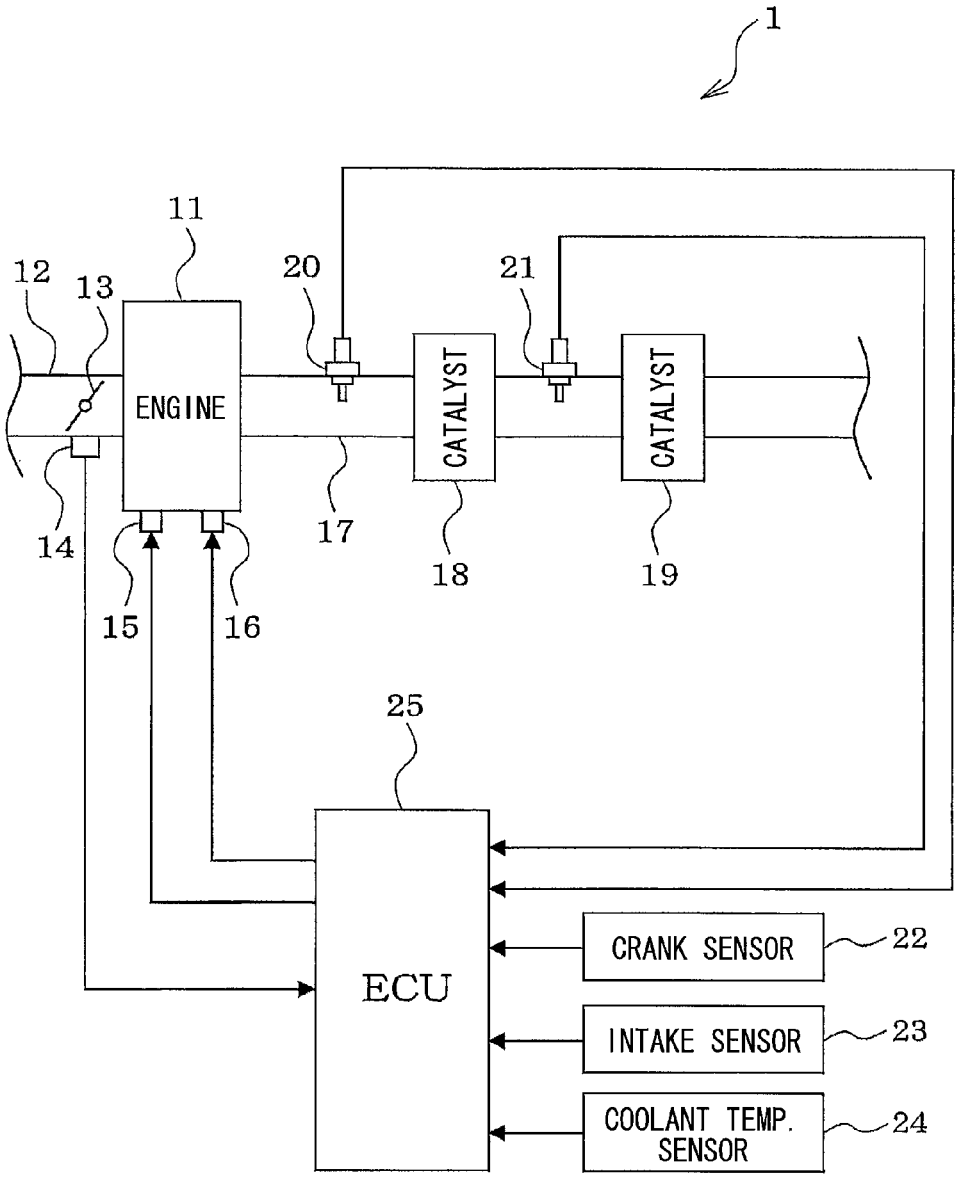
FIG. 1 is a schematic diagram showing an emission control system according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described with reference to FIGS. 1 to 9. First, an emission control system 1 of the present embodiment will be described based on FIG. 1.

The emission control system 1 includes an engine 11 (internal combustion engine), an intake pipe 12 through which intake air flows to be drawn into the engine 11, a throttle valve 13 provided in the intake pipe 12, and a throttle sensor 14 provided in the intake pipe 12. An open degree (throttle-open degree) of the throttle valve 13 is adjusted by using a motor or the like, and the throttle sensor 14 detects the throttle-open degree of the throttle valve 13. The engine 11 includes fuel injection valves 15 attached respectively to cylinders of the engine 11 to inject fuel into the cylinders or into intake ports of the cylinders, and spark plugs 16 provided in a cylinder head of the engine 11 adjacent to the cylinders respectively. The spark plugs 16 generate electric spark to ignite air/fuel mixture in the cylinders.

The emission control system 1 further includes an exhaust pipe 17 through which exhaust gas discharged from the engine 11 passes, an upstream catalyst 18 (purification catalyst) provided in the exhaust pipe 17, a downstream catalyst 19 arranged downstream of the upstream catalyst 18 in a flow direction of the exhaust gas in the exhaust pipe 17, an A/F sensor 20 (linear A/F sensor, upstream gas sensor) arranged upstream of the upstream catalyst 18 in the exhaust-gas flow direction in the exhaust pipe 17, and an oxygen sensor 21 ($O_2$ sensor, downstream gas sensor) arranged downstream of the upstream catalyst 18, i.e., between the upstream catalyst 18 and the downstream catalyst 19 in the exhaust-gas flow direction in the exhaust pipe 17. The upstream catalyst 18 and the downstream catalyst 19 are, for example, three-way catalysts that purify substances, such as carbon monoxide (CO), hydrocarbon (HC) and nitrogen oxide (NOx), contained in the exhaust gas. The A/F sensor 20 outputs a linear signal dependent on an air-fuel ratio of the exhaust gas. The oxygen sensor 21 outputs a voltage that changes depending on whether the air-fuel ratio of the exhaust gas is higher or lower than the stoichiometric air-fuel ratio, in other words, whether the air-fuel ratio is lean or rich. When the air-fuel ratio is higher than the stoichiometric air-fuel ratio, it can be said that the air-fuel ratio is lean. When the air-fuel ratio is lower than the stoichiometric air-fuel ratio, it can be said that the air-fuel ratio is rich. The oxygen gas sensor 21 may be used as an example of an exhaust-gas sensor that detects an air-fuel ratio of exhaust gas or detects whether the exhaust gas is rich or lean.

Additionally, the emission control system 1 includes various sensors that includes a crank sensor 22 that outputs a pulse signal at each predetermined rotation angle (i.e., crank angle) of a crankshaft of the engine 11, an intake sensor 23 that detects an intake air amount drawn into the engine 11, and a coolant temperature sensor 24 that detects a temperature of coolant for the engine 11. The rotation angle of the crankshaft and a rotation speed of the engine 11 are determined based on the signal outputted from the crank sensor 22.

Outputs of the above-described various sensors are input to an electronic control unit (ECU) 25. The ECU 25 includes a microcomputer 26 shown in FIG. 2, and executes a variety of engine control programs stored in a read-only memory (ROM) embedded in the microcomputer, so that the ECU 25 controls, for example, a fuel-injection amount, an ignition timing and the throttle degree (intake air amount) based on an operational state of the engine 11.

When a predetermined feedback condition is satisfied, the ECU 25 performs a main feedback control and a sub feedback control. In the main feedback control, an air-fuel ratio (fuel injection amount) is corrected based on an output of the A/F sensor 20 (upstream gas sensor) so that an air-fuel ratio (upstream air-fuel ratio UR) of exhaust gas flowing upstream of the upstream catalyst 18 becomes a target air-fuel ratio TR. In the sub feedback control, the ECU 25 corrects the target air-fuel ratio based on an output from the oxygen sensor 21 (downstream gas sensor) so that an air-fuel ratio of exhaust gas flowing downstream of the upstream catalyst 18 becomes a control target value (e.g., stoichiometric air-fuel ratio), or the ECU 25 corrects a correction amount in the main feedback control or the fuel injection amount.

Next, the oxygen sensor 21 will be described based on FIG. 2. The oxygen sensor 21 includes a sensor element 31 having a cup-like shape. The sensor element 31 is accommodated in a housing or an element case, and is arranged in the exhaust pipe 17 connected to the engine 11.

Figure 2:
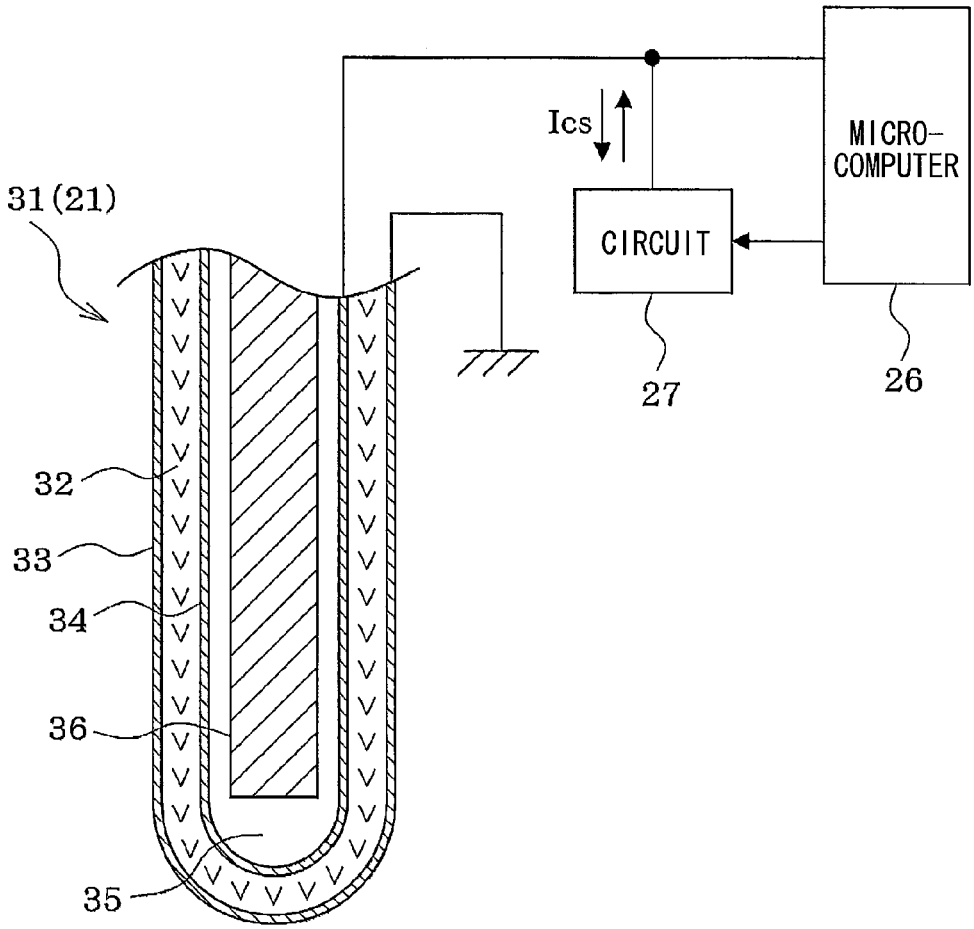
FIG. 2 is a schematic diagram showing a sectional view of a sensor element, a constant current circuit and a microcomputer of the emission control system according to the first embodiment.

The sensor element 31 has a cup-like shape in sectional surface as shown in FIG. 2. The sensor element 31 includes a solid electrolyte layer 32 (solid electrolyte body), an exhaust electrode layer 33 provided on an outer periphery of the solid electrolyte layer 32, and an atmosphere electrode layer 34 provided on an inner periphery of the solid electrolyte layer 32. The solid electrolyte layer 32 is made, for example, of an oxide sintered body having an oxygen-ion conductivity, and the oxide sintered body is a solid solution in which a solute, such as CaO, MgO, $Y_2O_3$ or $Yb_2O_3$, is dissolved as a stabilizing agent in a solvent, such as $ZrO_2$, $HfO_2$, $ThO_2$ or $Bi_2O_3$. The electrode layers 33 and 34 are made of noble metal superior in catalytic activity, such as platinum, and are covered with a porous material via chemical plating treatment. These electrode layers 33 and 34 are used as an example of a pair of electrodes (sensor electrodes) which are opposed to each other. The solid electrolyte layer 32 has an atmosphere space 35 surrounded by the solid electrolyte layer 32, and a heater 36 is accommodated in the atmosphere space 35. The heater 36 has a heating capacity enough to activate the sensor element 31, and the sensor element 31 is thereby heated as a whole by heat energy generated by the heater 36. An activation temperature of the oxygen sensor 21 is, for example, approximately from 350° C. to 400° C. The atmosphere space 35 introduces air therein from atmosphere so that an oxygen concentration in the atmosphere space 35 is kept at a predetermined degree.

The exhaust gas flows on outer side of the solid electrolyte layer 32 of the sensor element 31, in other words, the exhaust electrode layer 33 is exposed to the exhaust gas. The air introduced from atmosphere into the sensor element 31 is trapped on an inner side of the solid electrolyte layer 32, in other words, the atmosphere electrode layer 34 is exposed to the introduced air. Hence, an electromotive force is generated between the electrode layers 33 and 34 depending on a difference of an oxygen concentration (oxygen partial pressure) between in the exhaust gas and in the introduced air. The sensor element 31 generates an electromotive force that changes depending on whether the air-fuel ratio of the exhaust gas is rich or lean. Accordingly, the oxygen sensor 21 outputs a signal of the electromotive force dependent on the oxygen concentration (i.e., air-fuel ratio) of the exhaust gas.

Figure 3:
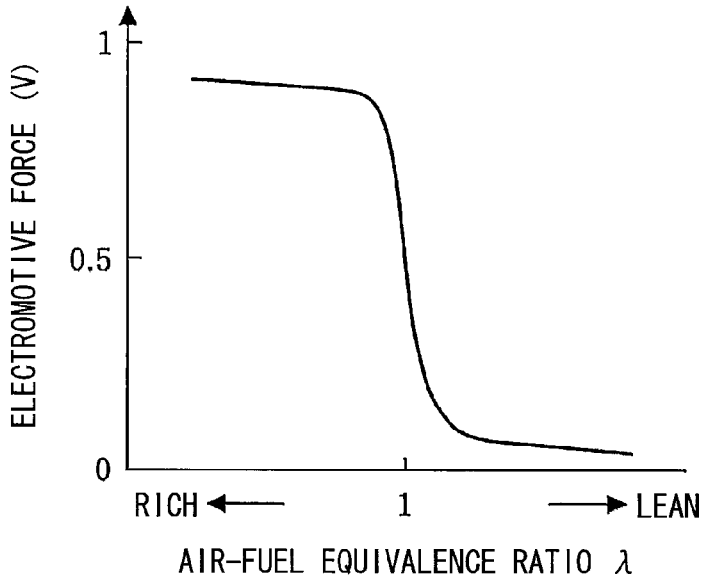
FIG. 3 is a diagram showing a relationship between an air-fuel ratio (air-fuel equivalence ratio λ) of exhaust gas and an electromotive force generated in the sensor element according to the first embodiment.

As shown in FIG. 3, the sensor element 31 generates an electromotive force that changes depending whether the air-fuel ratio of the exhaust gas is larger or smaller than the stoichiometric air-fuel ratio, i.e., whether the air-fuel ratio of the exhaust gas is lean or rich. Here, when the air-fuel ratio of the exhaust gas is equal to the stoichiometric air-fuel ratio, an air-fuel equivalence ratio $\lambda$ is equal to 1. The sensor element 31 has a characteristic such that the electromotive force generated by the sensor element 31 changes rapidly near the stoichiometric air-fuel ratio at which the air-fuel equivalence ratio $\lambda$ is equal to 1. The sensor element 31 generates a rich electromotive force when the air-fuel ratio is rich, and the sensor element 31 generates a lean electromotive force different from the rich electromotive force in voltage value when the air-fuel ratio is lean. For example, the rich electromotive force is approximately 0.9 V, and the lean electromotive force is approximately 0 V.

As shown in FIG. 2, the exhaust electrode layer 33 of the sensor element 31 is grounded, and the atmosphere electrode layer 34 is connected to the microcomputer 26. When the sensor element 31 generates an electromotive force depending on the air-fuel ratio (i.e., oxygen concentration) of the exhaust gas, a detection signal corresponding to the generated electromotive force is output to the microcomputer 26. The microcomputer 26 is, for example, provided in the ECU 25, and calculates the air-fuel ratio of the exhaust gas based on the detection signal. The microcomputer 26 may calculate a rotational speed of the engine 11 or an intake air amount based on detection results of the above-described various sensors.

When the engine 11 is operated, an actual air-fuel ratio of the exhaust gas may alternate between rich and lean repeatedly. In such case, if the oxygen sensor 21 is low in detection responsiveness, the low detection responsiveness may have an affect on performance of the engine 11. For example, in a high-load operation of the engine 11, an amount of NOx in the exhaust gas may become larger than expected.

Figure 4A:
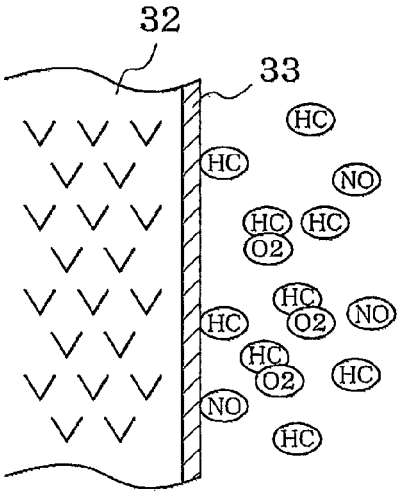
FIG. 4A is a schematic diagram showing a state of components of the exhaust gas around the sensor element when an actual air-fuel ratio changes from rich to lean, according to the first embodiment.
Figure 4B:
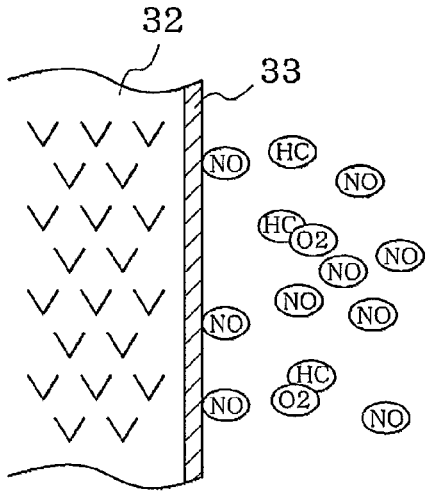
FIG. 4B is a schematic diagram showing a state of components of the exhaust gas around the sensor element when the actual air-fuel ratio changes from lean to rich, according to the first embodiment.

The detection responsiveness of the oxygen sensor 21 in a case where the actual air-fuel ratio of the exhaust gas changes from rich to lean or from lean to rich will be described. When the actual air-fuel ratio of the exhaust gas discharged from the engine 11 (i.e., the actual air-fuel ratio of the exhaust gas flowing downstream of the upstream catalyst 18) changes from rich to lean or from lean to rich, component composition of the exhaust gas changes. Components of exhaust gas, which flows around the oxygen sensor 21 immediately before the change of the actual air-fuel ratio, may remain near the oxygen sensor 21 immediately after the change of the actual air-fuel ratio. Here, the output of the oxygen sensor 21 changes in accordance with the change of the actual air-fuel ratio. Therefore, the remained components near the oxygen sensor 21 may cause the output change of the oxygen sensor 21 to retard. In other words, the detection responsiveness of the oxygen sensor 21 may decrease. Specifically, immediately after the actual air-fuel ratio changes from rich to lean as shown in FIG. 4A, a rich component such as HC remains near the exhaust electrode layer 33, and disturbs a reaction of a lean component such as NOx. As a result, detection responsiveness of the oxygen sensor 21 may decrease when the actual air-fuel ratio changes from rich to lean. Immediately after the actual air-fuel ratio changes from lean to rich as shown in FIG. 4B, the lean component such as NOx remains near the exhaust electrode layer 33, and disturbs a reaction of the rich component such as HC. The detection responsiveness of the oxygen sensor 21 may decrease also when the actual air-fuel ratio from lean to rich.

Figure 5:
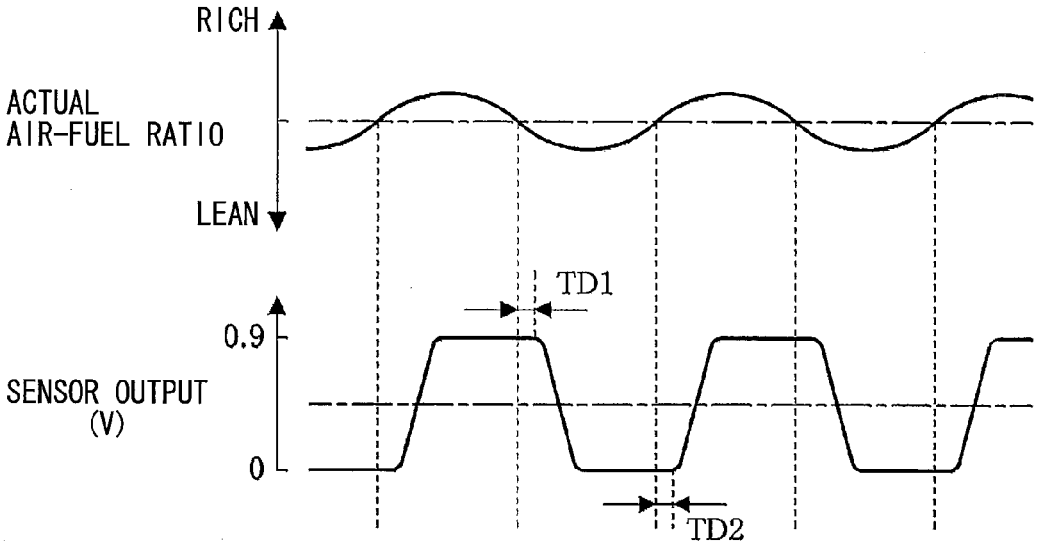
FIG. 5 is a time chart showing behavior of a sensor output in accordance with change of the actual air-fuel ratio in a case where a constant current is not applied to the sensor element, according to the first embodiment.

The output change of the oxygen sensor 21 in a case where a constant current Ics described later is not applied to the sensor element 31 will be described referring to FIG. 5. When the actual air-fuel ratio alternates between rich and lean, an output (sensor output) of the oxygen sensor 21 alternates between a rich electromotive force (e.g., 0.9 V) and a lean electromotive force (e.g., 0 V) in accordance with the alternation of the actual air-fuel ratio. In this case, the change of the sensor output lags behind the change of the actual air-fuel ratio. As shown in FIG. 5, when the actual air-fuel ratio changes from rich to lean, the sensor output of the oxygen sensor 21 changes behind the change of the actual air-fuel ratio by a time TD1. When the actual air-fuel ratio changes from lean to rich, the sensor output of the oxygen sensor 21 changes behind the change of the actual air-fuel ratio by a time TD2.

In the first embodiment, as shown in FIG. 2, a constant current circuit 27 is connected to the atmosphere electrode layer 34. The constant current circuit 27 may be used as an example of a constant current supply portion that supplies a constant current between the electrode layers 33 and 34. The microcomputer 26 controls the constant current circuit 27 to supply a constant current Ics to the exhaust electrode layer 33 and the atmosphere electrode layer 34, so that the constant current Ics flows in a predetermined direction between the electrode layers 33, 34. Accordingly, the constant current circuit 27 changes an output characteristic of the oxygen sensor 21 such that the detection responsiveness of the oxygen sensor 21 changes. The microcomputer 26 determines a flow direction and a flow rate of the constant current Ics that is to flow between the electrode layers 33, 34, and the microcomputer 26 controls the constant current circuit 27 so that the constant current Ics flows in the determined flow direction and at the determined flow rate.

The constant current circuit 27 supplies the constant current Ics in positive value or negative value to the atmosphere electrode layer 34, and is capable of adjusting the constant current Ics variably. In other words, the microcomputer 26 controls the constant current Ics variably by a pulse width modulation control (PMW control). In the constant current circuit 27, the constant current Ics is adjusted depending on a duty-cycle signal output from the microcomputer 26, and the adjusted constant current Ics is supplied between the exhaust electrode layer 33 and the atmosphere electrode layer 34.

In the present embodiment, the constant current Ics flowing from the exhaust electrode layer 33 to the atmosphere electrode layer 34 is defined as a negative constant current (−Ics), and the constant current Ics flowing from the atmosphere electrode layer 34 to the exhaust electrode layer 33 is defined as a positive constant current (+Ics).

Figure 6A:
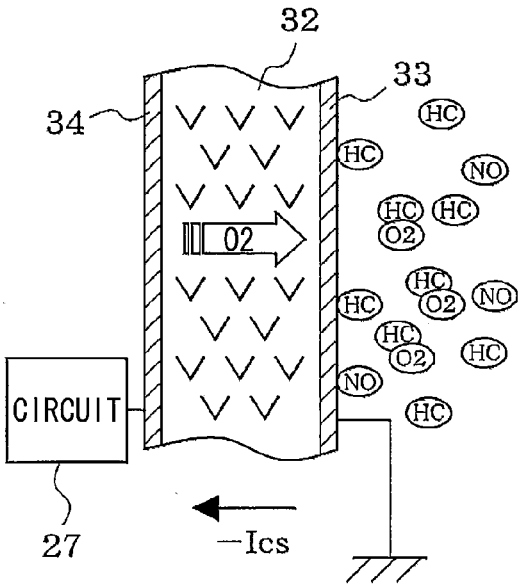
FIG. 6A is a schematic diagram showing a state of components of the exhaust gas around the sensor element when the actual air-fuel ratio changes from rich to lean, and showing a current direction in the sensor element when a lean responsiveness of the sensor element is increased, according to the first embodiment.

When the detection responsiveness of the oxygen sensor 21 is increased in a case where the actual air-fuel ratio changes from rich to lean, in other words, when a lean sensitivity of the oxygen sensor 21 is increased, the negative constant current (−Ics) is output from the constant current circuit 27 so that oxygen is supplied from the atmosphere electrode layer 34 to the exhaust electrode layer 33 through the solid electrolyte layer 32 as shown in FIG. 6A. The supply of oxygen from the atmosphere electrode layer 34 to the exhaust electrode layer 33 promotes oxidation reaction of the rich component (e.g., HC) that exists (remains) around the exhaust electrode layer 33. Hence, the rich component can be removed from around the exhaust electrode layer 33 promptly. Accordingly, the lean component (e.g., NOx) becomes to be easy to react at the exhaust electrode layer 33, and the detection responsiveness of the oxygen sensor 21 can be increased when the actual air-fuel ratio changes to rich to lean.

Figure 6B:
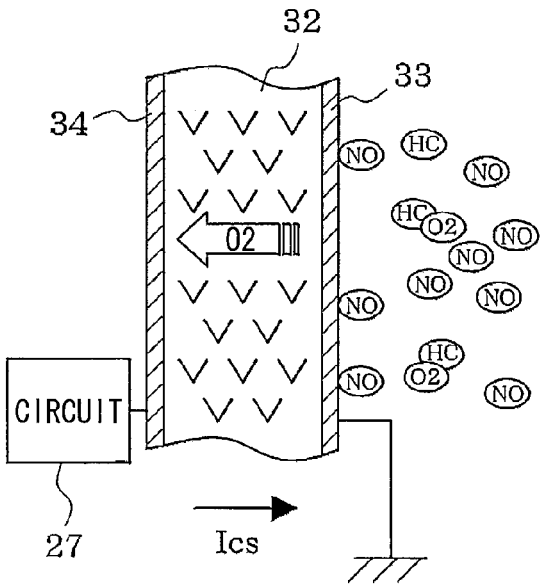
FIG. 6B is a schematic diagram showing a state of components of the exhaust gas around the sensor element when the actual air-fuel ratio changes from lean to rich, and showing a current direction in the sensor element when a rich responsiveness of the sensor element is increased, according to the first embodiment.

When the detection responsiveness of the oxygen sensor 21 is increased in a case where the actual air-fuel ratio changes from lean to rich, in other words, when a rich sensitivity of the oxygen sensor 21 is increased, the positive constant current (+Ics) is output from the constant current circuit 27 so that oxygen is supplied from the exhaust electrode layer 33 to the atmosphere electrode layer 34 through the solid electrolyte layer 32 as shown in FIG. 6B. The supply of oxygen from the exhaust electrode layer 33 to the atmosphere electrode layer 34 promotes reduction reaction of the lean component (e.g., NOx) that exists (remains) around the exhaust electrode layer 33. Hence, the lean component can be removed from around the exhaust electrode layer 33 promptly. Accordingly, the rich component (e.g., HC) becomes to be easy to react at the exhaust electrode layer 33, and the detection responsiveness of the oxygen sensor 21 can be increased when the actual air-fuel ratio changes to lean to rich.

Figure 7:
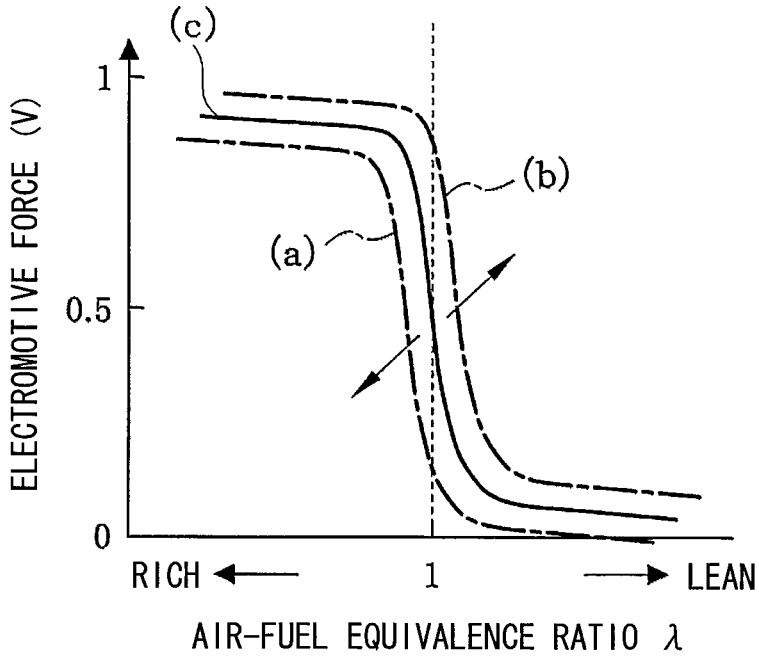
FIG. 7 is a diagram showing a relationship between the air-fuel ratio (air-fuel equivalence ratio λ) of the exhaust gas and the electromotive force generated in the sensor element according to the first embodiment.

FIG. 7 shows the output characteristic (electromotive force characteristic) of the oxygen sensor 21. The curve (a) shown in FIG. 7 is an output characteristic line of the oxygen sensor 21 when the detection responsiveness (lean sensitivity) is increased in a case where the actual air-fuel ratio changes from rich to lean. The curve (b) shown in FIG. 7 is an output characteristic line of the oxygen sensor 21 when the detection responsiveness (rich sensitivity) is increased in a case where the actual air-fuel ratio changes from lean to rich. The curve (c) shown in FIG. 7 is an output characteristic line same as that shown in FIG. 3, in other words, the curve (c) is when the constant current Ics is not applied to the electrode layers 33 and 34.

As described above, when the detection responsiveness (lean sensitivity) is increased in the case where the actual air-fuel ratio changes from rich to lean, the negative constant current (−Ics) flows between the electrode layers 33 and 34 so that oxygen is supplied from the atmosphere electrode layer 34 to the exhaust electrode layer 33 through the solid electrolyte layer 32 as shown in FIG. 6A. In this case, as shown in FIG. 7, the output characteristic line (a) is located on a richer side of the output characteristic line (c) in air-fuel equivalence ratio λ, and is located on a lower side of the output characteristic line (c) in electromotive force. Thus, even when the actual air-fuel ratio (air-fuel equivalence ratio λ) is within a rich region that is an air-fuel ratio region lower than the stoichiometric air-fuel ratio, the oxygen sensor 21 outputs the lean electromotive force when the actual air-fuel ratio is near the stoichiometric air-fuel ratio. Therefore, with respect to the output characteristic of the oxygen sensor 21, the detection responsiveness (lean sensitivity) of the oxygen sensor 21 can be increased when the actual air-fuel ratio changes from rich to lean.

When the detection responsiveness (rich sensitivity) is increased in the case where the actual air-fuel ratio changes from lean to rich, the positive constant current (+Ics) flows between the electrode layers 33 and 34 so that oxygen is supplied from the exhaust electrode layer 33 to the atmosphere electrode layer 34 through the solid electrolyte layer 32 as shown in FIG. 6B. In this case, as shown in FIG. 7, the output characteristic line (b) is located on a leaner side of the output characteristic line (c) in air-fuel equivalence ratio λ, and is located on a higher side of the output characteristic line (c) in electromotive force. Thus, even when the actual air-fuel ratio (air-fuel equivalence ratio λ) is within a lean region that is an air-fuel ratio region higher than the stoichiometric air-fuel ratio, the oxygen sensor 21 outputs the rich electromotive force when the actual air-fuel ratio is near the stoichiometric air-fuel ratio. Therefore, with respect to the output characteristic of the oxygen sensor 21, the detection responsiveness (rich sensitivity) of the oxygen sensor 21 can be increased when the actual air-fuel ratio changes from lean to rich.

In the first embodiment, in order to detect a decrease of a NOx purification rate of the upstream catalyst 18 promptly in a normal operation, the constant current circuit 27 is controlled to make the constant current Ics flow in a direction such that the lean sensitivity of the oxygen sensor 21 is increased. Accordingly, a lean responsiveness of the oxygen sensor 21 is increased. Specifically, the constant current circuit 27 is controlled to output the constant current Ics that is equal to a current value 10, so that the atmosphere electrode layer 34 supplies oxygen to the exhaust electrode layer 33. The lean responsiveness of the oxygen sensor 21 is the detection responsiveness of the oxygen sensor 21 with respect to lean gas that is exhaust gas having an actual air-fuel ratio leaner (i.e., higher) than the stoichiometric air-fuel ratio.

Figure 8:
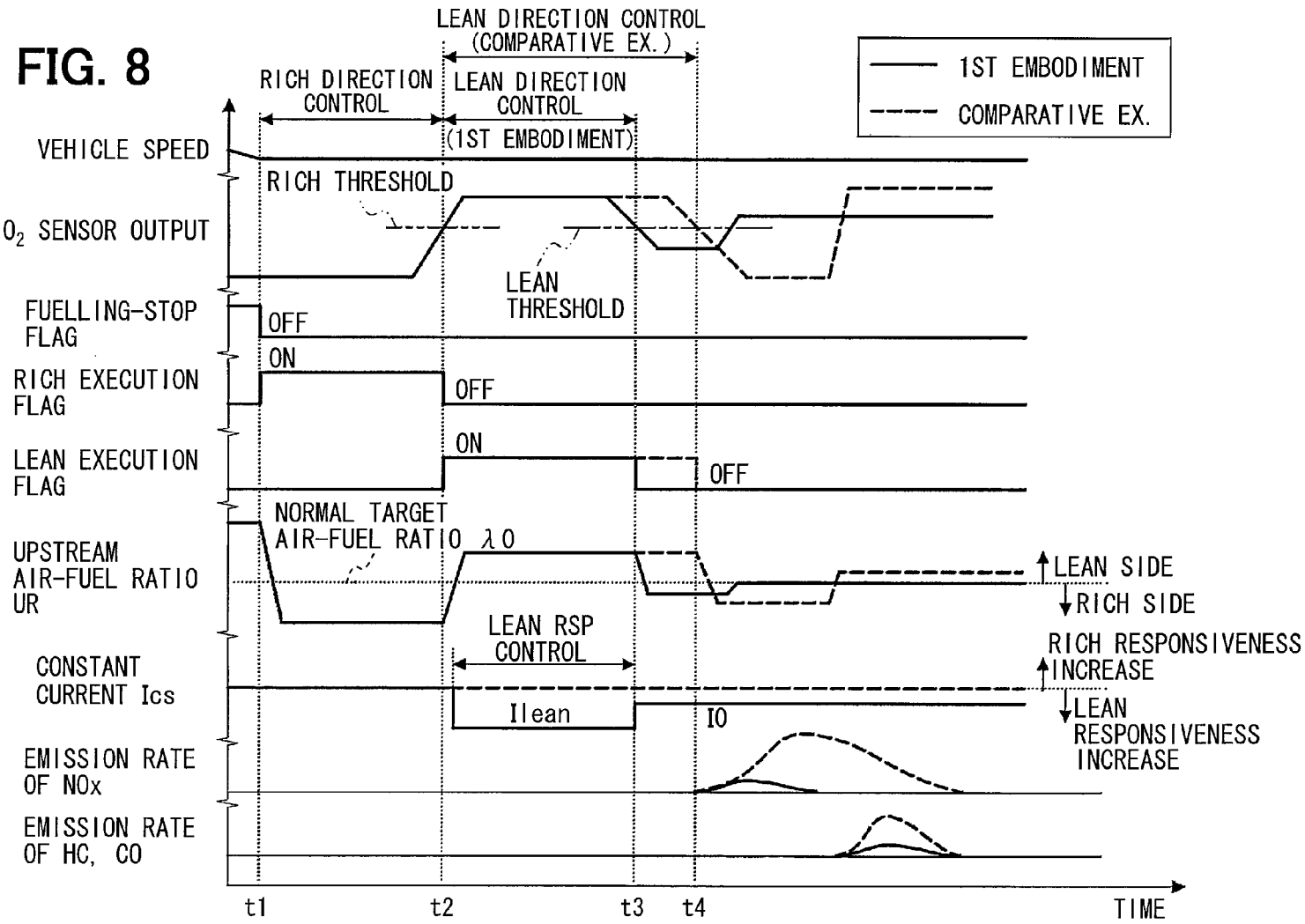
FIG. 8 is a time chart showing changes in vehicle speed, $O_2$ sensor output, state of a fuelling-stop flag, state of a rich execution flag, state of a lean execution flag, upstream air-fuel ratio, constant current, emission rate of NOx and emission rate of HC and CO, in an emission reduction control according to the first embodiment.
Figure 9:
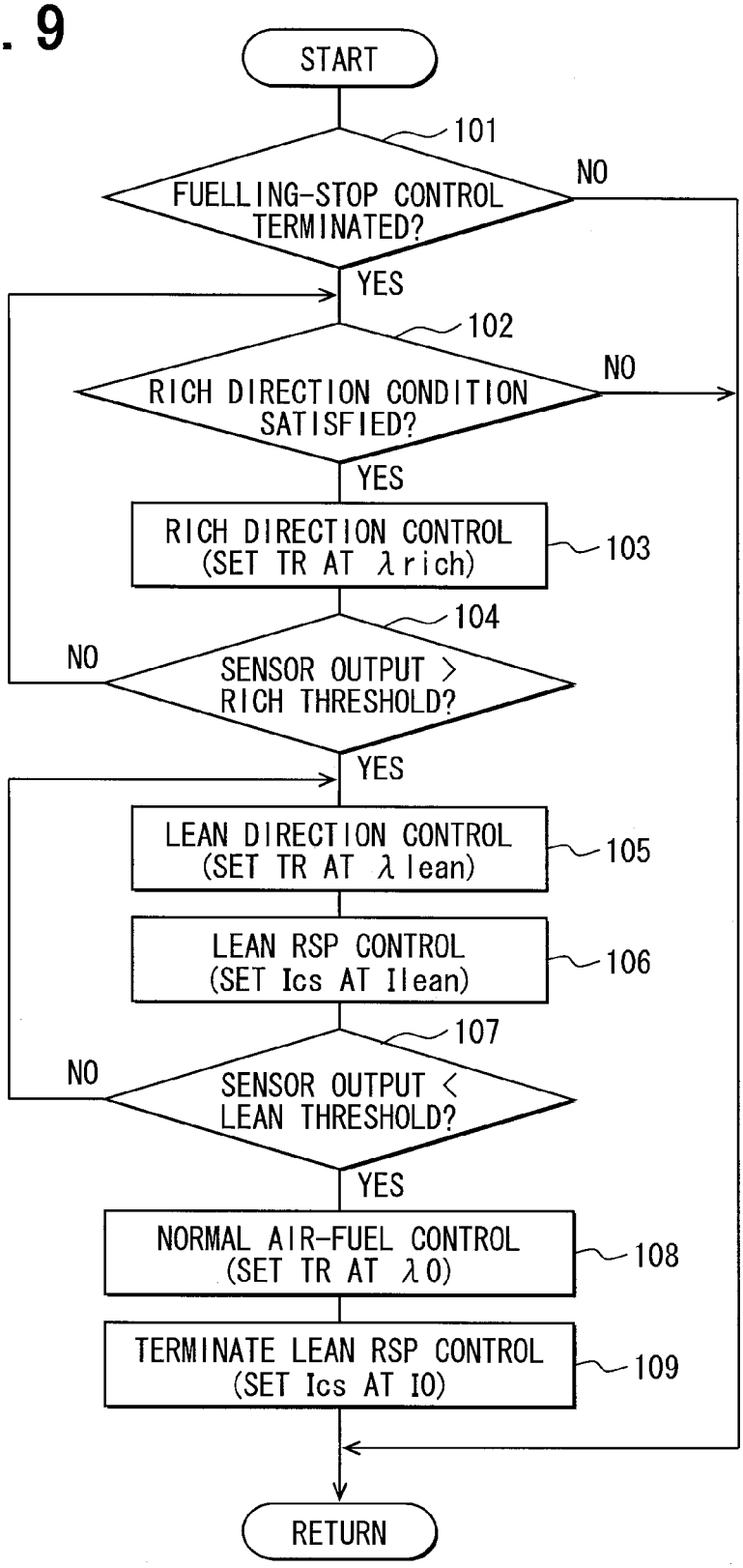
FIG. 9 is a flowchart showing a routine of the emission reduction control according to the first embodiment.

In the first embodiment, the ECU 25 (or the microcomputer 26) executes a routine of an emission reduction control shown in FIG. 9. In the emission reduction control, as shown in FIG. 8, a rich direction control is performed after a fuelling-stop control in which fuel injection of the engine 11 is stopped. In the rich direction control, the air-fuel ratio (upstream air-fuel ratio UR) of exhaust gas flowing upstream of the upstream catalyst 18 is controlled to become richer than the target air-fuel ratio (normal target air-fuel ratio λ0) that is set based on a normal operation condition. When the upstream catalyst 18 is determined to be in a rich state based on an output of the oxygen sensor 21 after a start of the rich direction control, the rich direction control is terminated. After the termination of the rich direction control, a lean direction control is performed in the emission reduction control. In the lean direction control, the upstream air-fuel ratio UR is controlled to become leaner than the normal target air-fuel ratio λ0. When the upstream catalyst 18 is determined to be in a lean state based on the output of the oxygen sensor 21 after a start of the lean direction control, the lean direction control is terminated. Additionally, in the emission reduction control, a lean responsiveness control (lean RSP control) is performed during the lean direction control. In the lean RSP control, the constant current circuit 27 is controlled to set the flow direction of the constant current Ics so that the lean responsiveness of the oxygen sensor 21 is increased.

As shown in FIG. 8, an execution condition of the fuelling-stop control becomes not to be satisfied during the fuelling-stop control, and a fuelling-stop flag is thereby turned off at time t1. Thus, the fuelling-stop control is terminated at time t1, in other words, the fuel injection of the engine 11 is resumed at time t1.

After the termination of the fuelling-stop control, i.e., after the resumption of the fuel injection, the upstream catalyst 18 may become in a lean state, in which the stored oxygen amount, i.e., adsorbed oxygen amount in the upstream catalyst 18 is relatively large. Hence, catalytic conversion efficiency of the upstream catalyst 18 with respect to NOx may decrease in the lean state of the upstream catalyst 18. In order to limit the decrease of the catalytic conversion efficiency due to the lean state of the upstream catalyst 18, in other words, in order to reduce the adsorbed oxygen amount in the upstream catalyst 18, the rich direction control is performed. Thus, a rich execution flag is turned on at time t1 so that the rich direction control is performed. Specifically, the rich direction control is performed when an execution condition (rich direction condition) of the rich direction control is satisfied after the termination of the fuelling-stop control. In other words, the rich direction control is performed when the upstream catalyst 18 is determined to be in the lean state after the termination of the fuelling-stop control. By performing the rich direction control, the air-fuel ratio (upstream air-fuel ratio UR) of the exhaust gas flowing upstream of the upstream catalyst 18 can be richer than the normal target air-fuel ratio λ0 that is normally set. As a result, it can be limited that the upstream catalyst 18 becomes to be in the lean state, in other words, the stored oxygen amount in the upstream catalyst 18 can be reduced.

After the start of the rich direction control, the output ($O_2$ sensor output) of the oxygen sensor 21 becomes higher than a predetermined rich threshold at time t2. The predetermined rich threshold corresponds, for example, to the stoichiometric air-fuel ratio or a little richer. At time t2, it is determined that the limitation of the lean state of the upstream catalyst 18 is finished, in other words, the upstream catalyst 18 is determined to be in the rich state. Therefore, the rich execution flag is turned off, so that the rich direction control is terminated at time t2.

After the termination of the rich direction control, the upstream catalyst 18 may become in the rich state, in which the stored oxygen amount in the upstream catalyst 18 is relatively small. Hence, catalytic conversion efficiency of the upstream catalyst 18 with respect to CO or HC may decrease in the rich state of the upstream catalyst 18. In order to limit the decrease of the catalytic conversion efficiency of the upstream catalyst 18 with respect to CO or HC, in other words, in order to increase the stored oxygen amount in the upstream catalyst 18, the lean direction control is performed. Thus, a lean execution flag is turned on at time t2 so that the lean direction control is performed. In the lean direction control, the upstream air-fuel ratio UR is controlled to become leaner than the normal target air-fuel ratio λ0 that is normally set based on the normal operation condition. In other words, the air-fuel ratio (upstream air-fuel ratio UR) of the exhaust gas flowing upstream of the upstream catalyst 18 can be leaner than the normal target air-fuel ratio λ0 that is normally set. As a result, it can be limited that the upstream catalyst 18 becomes in the rich state, in other words, the stored oxygen amount in the upstream catalyst 18 can be increased. Accordingly, the decrease of the catalytic conversion efficiency of the upstream catalyst 18 with respect to CO or HC (rich component) generated in the rich direction control can be prevented, and an emission rate of CO and HC can be reduced.

After a start of the lean direction control, the output of the oxygen sensor 21 becomes lower than a predetermined lean threshold at time t3. The predetermined lean threshold corresponds, for example, to the stoichiometric air-fuel ratio or a little leaner. At time t3, it is determined that the limitation of the rich state of the upstream catalyst 18 is finished, in other words, it is determined that the upstream catalyst 18 is in the lean state. Thus, the lean execution flag is turned off, so that the lean direction control is terminated at time t3.

In a comparative example shown by thick dash lines in FIG. 8, the lean RSP control, in which the lean responsiveness of the oxygen sensor 21 is increased, is not performed during the lean direction control. In this case, the output of the oxygen sensor 21 becomes lower than the lean threshold at time t4. Thus, it is determined that the limitation of the rich state of the upstream catalyst 18 is finished at time t4, in other words, it is determined that the upstream catalyst 18 is in the lean state at time t4. Accordingly, the lean execution flag is turned off at time t4, so that the lean direction control is terminated. In this case, the output of the oxygen sensor 21 may become lower than the lean threshold after an almost entire region of the upstream catalyst 18 becomes in the lean state. As a result, the catalytic conversion efficiency with respect to NOx (lean component) may decrease in the comparative example.

In the first embodiment shown by thick solid lines in FIG. 8, the lean RSP control is performed during the lean direction control. The lean direction control is terminated at time t3 in the first embodiment. At time t3, the output of the oxygen sensor 21 becomes lower than the lean threshold, and it is determined that the limitation of the rich state of the upstream catalyst 18 is finished, in other words, it is determined that the upstream catalyst 18 is in the lean state. In the lean RSP control, the constant current circuit 27 is controlled to apply the constant current Ics and to set a flow direction of the constant current Ics so as to increase the lean sensitivity of the oxygen sensor 21 more than the lean sensitivity of the oxygen sensor 21 in the normal operation, so that the lean responsiveness of the oxygen sensor 21 is increased. Accordingly, the output of the oxygen sensor 21 becomes lower than the lean threshold before an almost entire region of the upstream catalyst 18 becomes in the lean state. In other words, it can be determined early that the upstream catalyst 18 is in the lean state, and the lean direction control can be terminated relatively early. Consequently, in the first embodiment, the decrease of the catalytic conversion efficiency with respect to NOx (lean component) generated in the lean direction control can be prevented, and the emission rate of NOx can be reduced.

The routine of the emission reduction control executed by the ECU 25 (or the microcomputer 26) will be described with reference to FIG. 9.

The routine of the emission reduction control shown in FIG. 9 is repeatedly executed in a predetermined period in a state where the ECU 25 is turned on, and may be used as examples of a rich direction control portion, a lean direction control portion, a characteristic control portion and a catalytic-state determination portion. When the emission reduction control is started, it is determined firstly at step 101 whether the fuelling-stop control is terminated, in other words, it is determined whether the fuel injection is resumed. When the fuelling-stop control is determined not to be terminated at step 101, the routine of the emission reduction control is terminated without performing any other control operations.

When the fuelling-stop control is determined to be terminated at step 101, in other words, when the fuel injection is determined to be resumed, it is determined at step 102 whether the rich direction condition is satisfied. Here, the rich direction condition includes conditions (1) to (3) shown as follows.

(1) Warm-up of the upstream catalyst 18 is finished.

(2) The stored oxygen amount (detection value or estimate value) in the upstream catalyst 18 is equal to or higher than a predetermined value, or the fuelling-stop control is performed for a predetermined time period or more.

(3) A request to stop the engine 11 is not provided.

When the above-described all conditions (1) to (3) are satisfied, the rich direction condition is satisfied. However, when either one of the above-described conditions (1) to (3) is not satisfied, the rich direction condition is not satisfied. Here, it can be determined whether the upstream catalyst 18 is in the lean state or not, based on whether the above-described condition (2) is satisfied or not. Therefore, a control portion of the ECU 25 (microcomputer 26) that performs a control operation of step 102 may be used as an example of the catalytic-state determination portion which determines whether the upstream catalyst 18 is in the lean state or in the rich state.

When the rich direction condition is determined not to be satisfied at step 102, the routine of the emission reduction control is terminated without performing any control operations.

When the rich direction condition is determined at step 102 to be satisfied, a control operation of step 103 is performed. At step S103, the rich direction control is performed by setting the target air-fuel ratio TR of the main feedback control at a rich air-fuel ratio λrich that is richer than the normal target air-fuel ratio λ0 that is normally set. In the rich direction control, the upstream air-fuel ratio UR is controlled to be richer than the normal target air-fuel ratio λ0. In other words, the air-fuel ratio of the exhaust gas flowing into the upstream catalyst 18 can be richer than the normal target air-fuel ratio λ0. Accordingly, it can be limited that the upstream catalyst 18 becomes in the lean state, in other words, the stored oxygen amount in the upstream catalyst 18 can be decreased.

Here, the normal target air-fuel ratio λ0 is, for example, set depending on an operational state of the engine 11 (e.g., engine rotation speed or engine load). The rich air-fuel ratio λrich that is richer than the normal target air-fuel ratio λ0 is not necessarily limited to be richer than the stoichiometric air-fuel ratio, and the rich air-fuel ratio λrich may be leaner than the stoichiometric air-fuel ratio. In other words, when the normal target air-fuel ratio λ0 is leaner than the stoichiometric air-fuel ratio, the rich air-fuel ratio λrich may be leaner than the stoichiometric air-fuel ratio.

At next step 104, it is determined whether the output ($O_2$ sensor output) of the oxygen sensor 21 is higher than the predetermined rich threshold (e.g., the stoichiometric air-fuel ratio or a little richer). When the output of the oxygen sensor 21 is determined to be equal to or lower than the rich threshold, the control operation of step 102 is performed. When the output of the oxygen sensor 21 is determined at step 104 to be higher than the rich threshold, it can be determined that the limitation of the lean state of the lean state of the upstream catalyst 18 is finished, in other words, it can be determined that the upstream catalyst 18 is in the rich state, so that a control operation of step 105 is performed. At step 105, the rich direction control is terminated, and the lean direction control is performed by setting the target air-fuel ratio TR of the main feedback control at a lean air-fuel ratio λlean that is leaner than the normal target air-fuel ratio λ0 that is normally set. In the lean direction control, the upstream air-fuel ratio UR is controlled to be leaner than the normal target air-fuel ratio λ0. In other words, the air-fuel ratio of the exhaust gas flowing into the upstream catalyst 18 can be leaner than the normal target air-fuel ratio λ0. Accordingly, it can be limited that the upstream catalyst 18 becomes in the rich state, in other words, the stored oxygen amount in the upstream catalyst 18 can be increased.

The lean air-fuel ratio λlean that is leaner than the normal target air-fuel ratio λ0 is not necessarily limited to be leaner than the stoichiometric air-fuel ratio, and the lean air-fuel ratio λlean may be richer than the stoichiometric air-fuel ratio. In other words, when the normal target air-fuel ratio λ0 is richer than the stoichiometric air-fuel ratio, the lean air-fuel ratio λlean may be richer than the stoichiometric air-fuel ratio.

At next step 106, the lean RSP control is performed, so that the constant current circuit 27 is controlled to set the flow direction of the constant current Ics so that the lean responsiveness of the oxygen sensor 21 is increased to be higher than the lean responsiveness of the oxygen sensor 21 in the normal operation. In the lean RSP control, the constant current Ics applied to the electrode layers 33, 34 is set at a current value Ilean that is higher in absolute value than the current value I0 of the constant current Ics in the normal operation (|Ilean|>|I0|). Accordingly, the lean responsiveness of the oxygen sensor 21 can be made to be higher in the lean RSP control than in the normal operation.

Moreover, in the lean RSP control, the current value Ilean of the constant current Ics applied to the electrode layers 33, 34 may be a predetermined fixed value. Alternatively, the current value Ilean of the constant current Ics applied to the electrode layers 33, 34 may be set based on the operational state of the engine 11 (e.g., the engine rotation speed or the engine load) by using a control map or the like. In this case, the current value Ilean of the constant current Ics applied to the electrode layers 33, 34 can be changed depending on the operational state of the engine 11, and the constant current Ics applied to the electrode layers 33, 34 can be set at an appropriate value that is dependent on the operational state of the engine 11.

At next step 107, it is determined whether the output (sensor output) of the oxygen sensor 21 is lower than the predetermined lean threshold (e.g., the stoichiometric air-fuel ratio or a little leaner). When the output of the oxygen sensor 21 is determined to be equal to or higher than the lean threshold, the control operation of step 105 is performed. When the output of the oxygen sensor 21 is determined to be lower than the lean threshold, it can be determined that the limitation of the rich state of the upstream catalyst 18 is finished, in other words, it can be determined that the upstream catalyst 18 is in the lean state, so that a control operation of step 108 is performed. At step 108, the lean direction control is terminated, and a normal air-fuel control is performed, in which the target air-fuel ratio TR of the main feedback control is set at the normal target air-fuel ratio λ0 that is normally set.

At next step 109, the lean RSP control is terminated, and the constant current Ics applied to the electrode layers 33, 34 is set at the current value I0 for the normal operation. When the upstream catalyst 18 is determined to be in the lean state after a start of the lean direction control, the lean direction control can be terminated, and the output characteristic of the oxygen sensor 21 can be changed to be an output characteristic of the oxygen sensor 21 for the normal operation.

In this case, control portions of the ECU 25 (microcomputer 26) which performs the control operations of steps 104 and 107 may be used as examples of the catalytic-state determination portion. Control portions of the ECU 25 (microcomputer 26) which perform the control operations of steps 106 and 109 may be used as an example of the characteristic control portion which performs the lean RSP control at least during the lean direction control. Control portions of the ECU 25 (microcomputer 26) which perform the control operations of steps 103 and 105 may be used an example of the rich direction control portion which performs and terminates the rich direction control. A control portion of the ECU 25 (microcomputer 26) which performs the control operation of step 105 may be used an example of the lean direction control portion which performs the lean direction control portion.

In the above-described first embodiment, the constant current circuit 27 provided outside the oxygen sensor 21 applies the constant current Ics between the electrode layers 33, 34. Accordingly, the output characteristic of the oxygen sensor 21 can be changed, and the rich responsiveness or the lean responsiveness of the oxygen sensor 21 can be increased. Furthermore, there is no need to incorporate an auxiliary electrochemical cell or the like to an inside of the oxygen sensor 21. Therefore, the output characteristic of the oxygen sensor 21 can be changed without great design changes and cost increase.

In the emission control system 1 of the first embodiment, the rich direction control is performed after the fuelling-stop control, so that the upstream air-fuel ratio UR is controlled to become richer than the normal target air-fuel ratio λ0 that is set based on the normal operation condition. After the rich direction control, the lean direction control is performed, so that the upstream air-fuel ratio UR is controlled to become leaner than the normal target air-fuel ratio λ0. In other words, by performing the lean direction control, the air-fuel ratio of the exhaust gas flowing into the upstream catalyst 18 can be leaner than the normal target air-fuel ratio λ0, and it can be limited that the upstream catalyst 18 becomes in the rich state. As a result, the decrease of the catalytic conversion efficiency with respect to CO or HC (rich component) generated in the rich direction control can be prevented, and the emission rate of CO and HC can be reduced.

Furthermore, the lean RSP control is performed during the lean direction control, so that the constant current circuit 27 is controlled to apply the constant current Ics and to set the flow direction of the constant current so as to increase the lean responsiveness of the oxygen sensor 21. It can be determined relatively early that the upstream catalyst 18 is in the lean state based on the output of the oxygen sensor 21, and the lean direction control can be terminated relatively early. Consequently, the decrease of the catalytic conversion efficiency with respect to NOx (lean component) generated in the lean direction control can be prevented, and the emission rate of NOx can be reduced.

Second Embodiment

A second embodiment of the present disclosure will be described referring to FIGS. 10 and 11. Explanations of components of an emission control system 1 of the second embodiment that are substantially same as components of the emission control system 1 of the first embodiment are omitted or simplified, and components of the emission control system 1 different from those of the first embodiment will be mainly described in the second embodiment.

Figure 11:
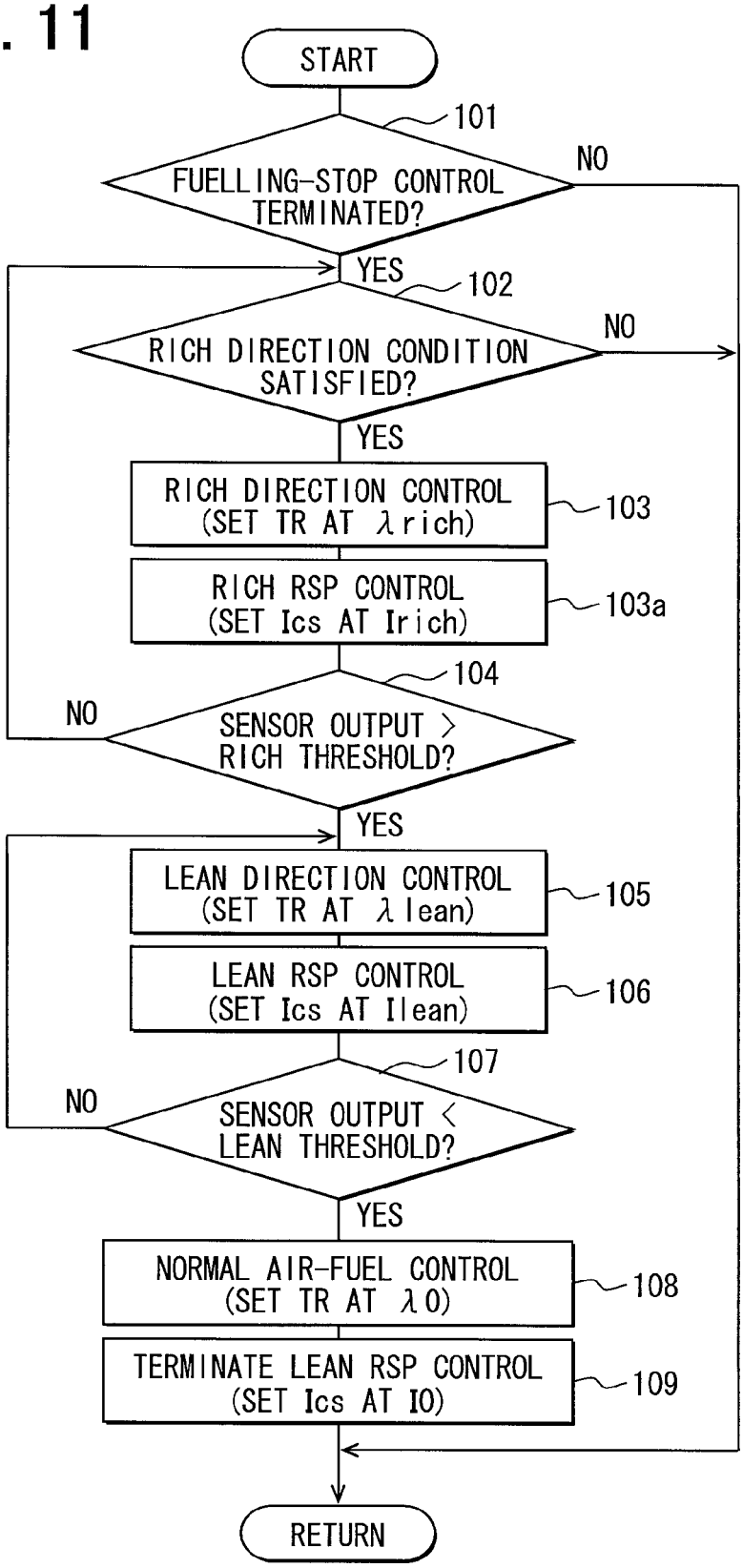
FIG. 11 is a flowchart showing a routine of the emission reduction control according to the second embodiment.

In the second embodiment, an ECU 25 (or a microcomputer 26) of the emission control system 1 executes a routine of an emission reduction control shown in FIG. 11. In the emission reduction control, a rich responsiveness control (rich RSP control) is performed, in which a constant current circuit 27 is controlled so as to increase rich responsiveness of an oxygen sensor 21 during the rich direction control. The rich responsiveness of the oxygen sensor 21 is the detection responsiveness of the oxygen sensor 21 with respect to rich gas that is exhaust gas having an actual air-fuel ratio richer (i.e., lower) than the stoichiometric air-fuel ratio. Specifically, in the rich RSP control, the constant current circuit 27 is controlled to output a positive constant current (+Ics) such that an exhaust electrode layer 33 supplies oxygen to an atmosphere electrode layer 34.

Figure 10:
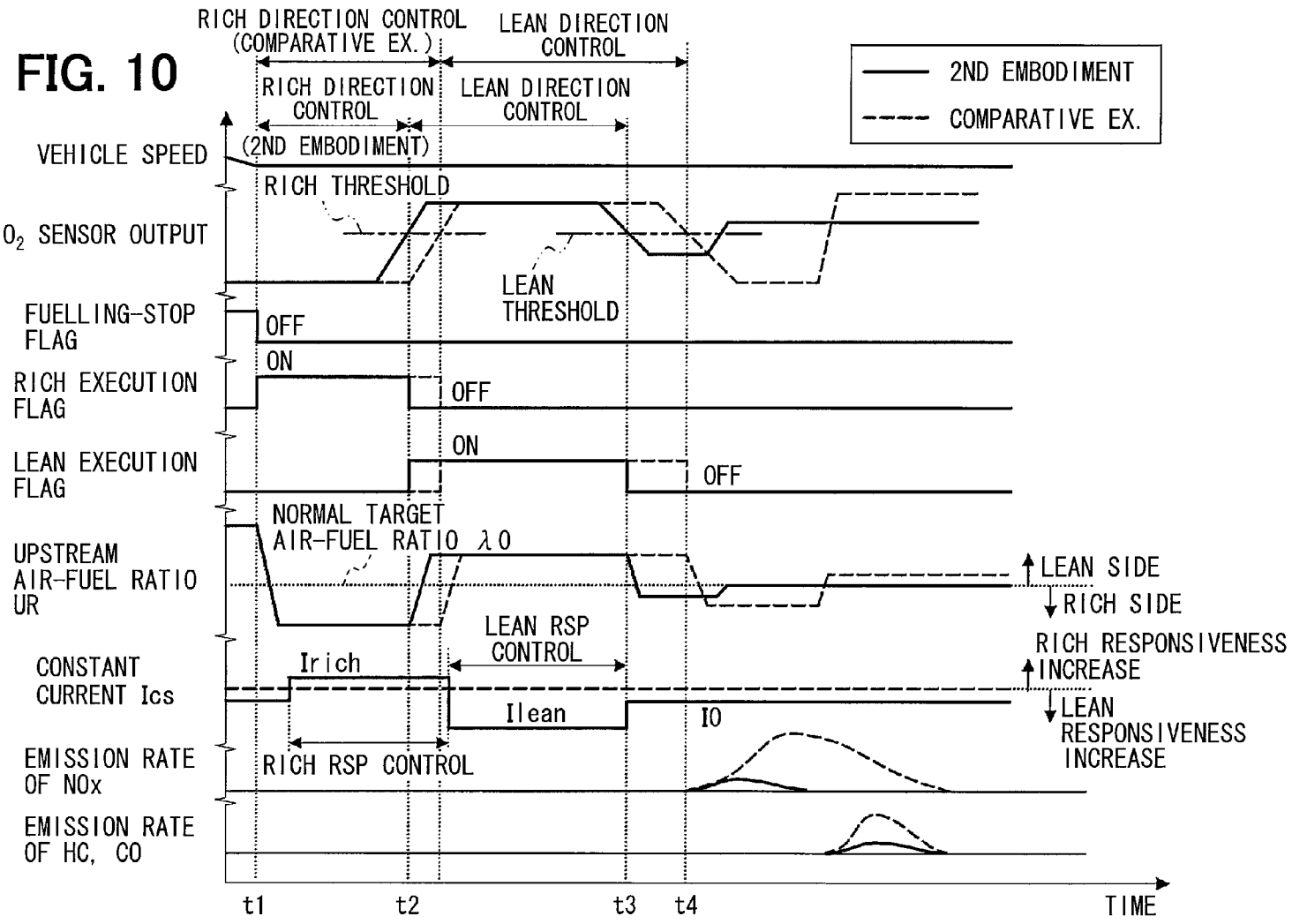
FIG. 10 is a time chart showing changes in vehicle speed, $O_2$ sensor output, state of a fuelling-stop flag, state of a rich execution flag, state of a lean execution flag, upstream air-fuel ratio, constant current, emission rate of NOx and emission rate of HC and CO, in an emission reduction control according to a second embodiment of the present disclosure.

As shown in FIG. 10, an execution condition of a fuelling-stop control is not satisfied in the fuelling-stop control, and a fuelling-stop flag is thereby turned off at time t1. At time t1, the fuelling-stop control is terminated, and fuel injection of an engine 11 is resumed. After the termination of the fuelling-stop control, the upstream catalyst 18 may be in a lean state in which a stored oxygen amount in the upstream catalyst 18 is relatively large, and a catalytic conversion efficiency of the upstream catalyst 18 with respect to NOx may thereby decrease. When an execution condition (rich direction condition) of the rich direction control is satisfied after the termination of the fuelling-stop control, in other words, when the upstream catalyst 18 is determined to be in the lean state after the termination of the fuelling-stop control, a rich execution flag is turned on at time t1 so that the rich direction control is performed. By performing the rich direction control, it can be limited that the upstream catalyst 18 becomes in the lean state, in other words, the stored oxygen amount in the upstream catalyst 18 can be decreased.

After the start of the rich direction control, an output ($O_2$ sensor output) of the oxygen sensor 21 becomes higher than a predetermined rich threshold (e.g., the stoichiometric air-fuel ratio or a little richer) at time t2, as shown in FIG. 10. When the output of the oxygen sensor 21 becomes higher than the predetermined rich threshold, it is determined that the limitation of the lean state of the upstream catalyst 18 is finished, in other words, it is determined that the upstream catalyst 18 is in a rich state in which the stored oxygen amount in the upstream catalyst 18 is relatively small. Thus, the rich execution flag is turned off, and the rich direction control is terminated at time t2.

In a comparative example shown by thick dash lines in FIG. 10, the rich RSP control is not performed during the rich direction control, in other words, the rich responsiveness of the oxygen sensor 21 is not increased during the rich direction control. In the comparative example, a time point, when the output of the oxygen sensor 21 becomes higher than the rich threshold after the start of the rich direction control, may lag behind the time point in the second embodiment. In other words, a time point, when it is determined that the limitation of the lean state of the upstream catalyst 18 is finished, may retard. Accordingly, an emission rate of CO or HC (rich component) generated in the rich direction control may increase, and emission gas may be deteriorated.

In the second embodiment shown by thick solid lines in FIG. 10, the rich RSP control is performed during the rich direction control, so that the constant current circuit 27 is controlled to increase the rich responsiveness of the oxygen sensor 21. For example, the constant current circuit 27 is controlled to apply the constant current Ics to the electrode layers 33, 34 and to set the flow direction of the constant current Ics, so as to increase the rich responsiveness of the oxygen sensor 21. More specifically, the constant current circuit 27 applies the positive constant current Irich (+Ics) to the electrode layers 33, 34. When the constant current circuit 27 is controlled to make the constant current Ics flow in a direction so as to increase a lean responsiveness of the oxygen sensor 21 before the start of the rich RSP control, the constant current circuit 27 may be controlled to stop applying the constant current Ics to the electrode layers 33, 34 in the rich RSP control, in other words, the constant current Ics may be set at zero in the rich RSP control.

Accordingly, in the second embodiment, the time point, at which the output of the oxygen sensor 21 becomes higher than the rich threshold (i.e., the time point when the limitation of the lean state of the upstream catalyst 18 is determined to be finished), can be prevented from retarding. Thus, a time point of the termination of the rich direction control can be made early relatively. As a result, the emission rate of CO or HC (rich component) generated in the rich direction control can be reduced, and the deterioration of the emission gas can be limited.

The routine that is shown in FIG. 11 and executed in the second embodiment includes a control operation of step 103*a* between the control operations of steps 103 and 104 described in the first embodiment. Other steps in the second embodiment are same as those in the first embodiment.

In the routine of the emission reduction control shown in FIG. 11, it is determined at step 102 whether the rich direction condition is satisfied or not after the fuelling-stop control is determined at step 101 to be terminated. When the rich direction condition is determined to be satisfied, the rich direction control is performed at step 103.

Subsequently, at step 103*a*, the rich RSP control is performed during the rich direction control, so that the constant current circuit 27 is controlled to increase the rich responsiveness of the oxygen sensor 21. Specifically, the constant current circuit 27 is controlled to apply the constant current Ics to the electrode layers 33, 34 and set the flow direction of the constant current Ics so as to increase the rich responsiveness of the oxygen sensor 21, in other words, the constant current circuit 27 is controlled to apply the positive constant current Irich (+Ics) to the electrode layers (33, 34). Alternatively, the constant current circuit 27 may be controlled to stop applying the constant current Ics to the electrode layers 33, 34 in the rich RSP control, in other words, the constant current Ics may be set at zero in the rich RSP control, when the lean responsiveness of the oxygen sensor 21 is increased by applying the constant current Ics before the start of the rich RSP control. A control portion of the ECU 25 (microcomputer 26) which performs the control operation of step 103*a* may be used an example of the characteristic control portion which performs the rich RSP control.

At next step 104, it is determined whether the output (sensor output) of the oxygen sensor 21 is higher than the rich threshold. When the output of the oxygen sensor 21 is determined to be higher than the rich threshold, the rich direction control is terminated, and the lean direction control is performed at step 105. The lean RSP control is performed during the lean direction control at step 106.

At step 107, it is determined whether the output of the oxygen sensor 21 is lower than the lean threshold. When the output of the oxygen sensor 21 is determined to be lower than the lean threshold, the lean direction control is terminated, and the normal air-fuel control is performed at step 108. The lean RSP control is terminated at step 109.

In the above-described second embodiment, the rich RSP control is performed during the rich direction control, so that the constant current circuit 27 is controlled to increase the rich responsiveness of the oxygen sensor 21 (i.e., detection responsiveness of the oxygen sensor 21 with respect to rich gas) during the rich direction control. Accordingly, the time point, at which the output of the oxygen sensor 21 becomes higher than the rich threshold after the start of the rich direction control (i.e., the time point when the limitation of the lean state of the upstream catalyst 18 is determined to be finished), can be prevented from retarding. Thus, the time point of the termination of the rich direction control can be made early relatively, and a performing period of the rich direction control can be thereby shortened. Hence, it can be limited that CO or HC (rich component) generated in the rich direction control is introduced into the upstream catalyst 18 too much. As a result, as shown in FIG. 10, a time period, in which an air-fuel ratio control (e.g., the rich direction control and the lean direction control) is performed after the termination of the fuelling-stop control, can be shortened.

In the above-describe first and second embodiments, whether the upstream catalyst 18 is in the lean state or not after the termination of the fuelling-stop control is determined based on whether the stored oxygen amount (detection value or estimate value) in the upstream catalyst 18 is equal to or larger than the predetermined value or not, or based on whether a performing period of the fuelling-stop control is equal to or longer than the predetermined time period or not. In other words, the rich direction control is performed after the termination of the fuelling-stop control when the stored oxygen amount in the upstream catalyst 18 is equal to or larger than the predetermined value, or when the performing period of the fuelling-stop control is equal to or longer than the predetermined time period. However, the rich direction control is not limited to be performed after the termination of the fuelling-stop control. For example, whether the upstream catalyst 18 is in the lean state or not may be determined based on whether the stored oxygen amount in the upstream catalyst 18 is equal to or larger than the predetermined value or not, or based on whether the output of the oxygen sensor 21 is lower than the predetermined lean threshold or not. In other words, the rich direction control may be performed when the stored oxygen amount in the upstream catalyst 18 is determined to be equal to or larger than the predetermined value, or when the output of the oxygen sensor 21 is determined to be lower than the predetermined lean threshold.

In the above-described first and second embodiments, whether the upstream catalyst 18 is in the rich state or not after the start of the rich direction control is determined based on whether the output of the oxygen sensor 21 is higher than the predetermined rich threshold or not. In other words, the rich direction control is terminated, and the lean direction control is performed, when the output of the oxygen sensor 21 is determined to be higher than the predetermined rich threshold. Alternatively, whether the upstream catalyst 18 is in the rich state or not may be determined based, for example, on whether the stored oxygen amount in the upstream catalyst 18 is equal to or smaller than a predetermined value or not. In other words, the rich direction control may be terminated, and the lean direction control may be performed, when the stored oxygen amount in the upstream catalyst 18 is determined to be equal to or smaller than the predetermined value.

In the above-described first and second embodiments, whether the upstream catalyst 18 is in the lean state or not after the start of the lean direction control is determined based on whether the output of the oxygen sensor 21 is lower than the predetermined lean threshold or not. In other words, the lean direction control is terminated when the output of the oxygen sensor 21 is determined to be lower than the predetermined lean threshold. Alternatively, whether the upstream catalyst 18 is in the lean state or not may be determined based, for example, on whether the stored oxygen amount in the upstream catalyst 18 is equal to or larger than a predetermined value or not. In other words, the lean direction control may be terminated when the stored oxygen amount in the upstream catalyst 18 is determined to be equal to or larger than the predetermined value.

In the above-described first and second embodiments, the constant current Ics, which is equal to I0, is applied to the electrode layers 33, 34 in the normal air-fuel control so that the lean responsiveness of the oxygen sensor 21 increases. Alternatively, the constant current Ics may be set at zero in the normal air-fuel control so that any current does not flow between the electrode layers 33, 34.

In the above-described first and second embodiments, the lean RSP control is performed during the lean direction control. Alternatively, the lean RSP control may be not performed during the lean direction control, and the lean threshold of the output of the oxygen sensor 21 may be set richer than the stoichiometric air-fuel ratio.

In the above-described first and second embodiments, the constant current circuit 27 is connected to the atmosphere electrode layer 34 of the oxygen sensor 21 (sensor element 31). However, for example, the constant current circuit 27 may be connected to the exhaust electrode layer 33 of the oxygen sensor 21 (sensor element 31), or the constant current circuit 27 may be connected to both the atmosphere electrode layer 34 and the exhaust electrode layer 33.

In the above-described first and second embodiments, the present disclosure is applied to the emission control system 1 including the oxygen sensor 21 that has the cup-like shaped sensor element 31. However, for example, the present disclosure may be applied to an emission control system including an oxygen sensor that has a sensor element having a laminated structure.

In the above-described first and second embodiments, the present disclosure is applied to the emission control system 1 in which the oxygen sensor 21 is located downstream of the upstream catalyst 18 in the flow direction of the exhaust gas. However, the present disclosure is not limited to the upstream catalyst 18 or the oxygen sensor 21. The present disclosure may be applied to an emission control system in which an exhaust gas sensor, such as an oxygen sensor or an air-fuel ratio sensor, is located downstream of a catalyst for purification of exhaust gas in a flow direction of the exhaust gas.

Additional advantages and modifications will readily occur to those skilled in the art. The disclosure in its broader terms is therefore not limited to the specific details, representative apparatus, and illustrative examples shown and described.

What is claimed is:

1. An emission control system for an internal combustion engine, comprising:

a catalyst used for purification of exhaust gas discharged from the engine;

an exhaust-gas sensor provided downstream of the catalyst in a flow direction of the exhaust gas to detect an air-fuel ratio of the exhaust gas or detect whether the exhaust gas is rich or lean, the exhaust-gas sensor including a sensor element that includes a pair of electrodes and a solid electrolyte body located between the pair of electrodes;

a constant current supply portion configured to change an output characteristic of the exhaust-gas sensor by applying a constant current between the pair of electrodes;

a catalytic-state determination portion configured to determine whether the catalyst is in a rich state or in a lean state;

a rich direction control portion configured to perform a rich direction control, in which an air-fuel ratio of the exhaust gas flowing into the catalyst is made to be richer than a normal target air-fuel ratio set based on a normal operation condition, when the catalytic-state determination portion determines that the catalyst is in the lean state, the rich direction control portion being configured to terminate the rich direction control when the catalytic-state determination portion determines that the catalyst is in the rich state after a start of the rich direction control;

a lean direction control portion configured to perform a lean direction control, in which the air-fuel ratio of the exhaust gas flowing into the catalyst is made to be leaner than the normal target air-fuel ratio set based on the normal operation condition, after the rich direction control portion terminates the rich direction control; and a characteristic control portion configured to perform a lean responsiveness control, in which the constant current supply portion is controlled to set a flow direction of the constant current so as to increase a detection responsiveness of the exhaust-gas sensor with respect to lean gas, at least during the lean direction control.

2. The emission control system according to claim 1, wherein the characteristic control portion sets the constant current in the lean responsiveness control at a value higher than a value of the constant current for a normal operation.

3. The emission control system according to claim 1, wherein the characteristic control portion sets the constant current at a value for a normal operation when the catalytic-state determination portion determines that the catalyst is in the lean state after a start of the lean direction control.

4. The emission control system according to claim 1, wherein the characteristic control portion sets a value of the constant current based on an operational state of the engine in the lean responsiveness control.

5. The emission control system according to claim 1, wherein the characteristic control portion performs a rich responsiveness control, in which the constant current supply portion is controlled to increase a detection responsiveness of the exhaust-gas sensor with respect to rich gas, during the rich direction control.

* * * * *